US008043071B2

(12) United States Patent
Fukano et al.

(10) Patent No.: US 8,043,071 B2
(45) Date of Patent: Oct. 25, 2011

(54) VACUUM GENERATING UNIT

(75) Inventors: Yoshihiro Fukano, Moriya (JP); Masayuki Oshima, Tsukuba (JP)

(73) Assignee: SMC Kabushiki Kaisha, Tokyo (JP)

( * ) Notice: Subject to any disclaimer, the term of this patent is extended or adjusted under 35 U.S.C. 154(b) by 778 days.

(21) Appl. No.: 12/168,333

(22) Filed: Jul. 7, 2008

(65) Prior Publication Data

US 2009/0032125 A1 Feb. 5, 2009

(30) Foreign Application Priority Data

Aug. 1, 2007 (JP) ..... 2007-201149

(51) Int. Cl.
*F04F 5/48* (2006.01)

(52) U.S. Cl. ..... 417/187

(58) Field of Classification Search ..... 417/182, 417/187, 192
See application file for complete search history.

(56) References Cited

U.S. PATENT DOCUMENTS

| | | | | |
|---|---|---|---|---|
| 4,402,651 | A | 9/1983 | Ise | |
| 4,432,701 | A | 2/1984 | Ise | |
| 4,655,692 | A * | 4/1987 | Ise | 417/187 |
| 4,865,521 | A | 9/1989 | Ise et al. | |
| 6,416,295 | B1 | 7/2002 | Nagai et al. | |
| 2006/0278282 | A1 | 12/2006 | Nagai et al. | |

FOREIGN PATENT DOCUMENTS

| | | |
|---|---|---|
| CN | 1287227 A | 3/2001 |
| CN | 1877138 A | 12/2006 |
| JP | 55-49599 | 4/1980 |
| JP | 63-193798 | 12/1988 |
| JP | 5-1000 | 1/1993 |
| JP | 6-37599 | 5/1994 |
| JP | 8-68400 | 3/1996 |
| JP | 2001-124000 | 5/2001 |
| JP | 2002-224984 | 8/2002 |
| JP | 2003-42134 | 2/2003 |
| JP | 2003-120598 | 4/2003 |
| JP | 2007-56746 | 3/2007 |

OTHER PUBLICATIONS

Notice of Decision for Grant issued on Jan. 20, 2011 in Korean Patent Application No. 10-2008-0075183 (with English Translation).

* cited by examiner

*Primary Examiner* — John Fox
(74) *Attorney, Agent, or Firm* — Oblon, Spivak, McClelland, Maier & Neustadt, L.L.P.

(57) ABSTRACT

An ejector functioning as a vacuum generating mechanism is disposed in a main body constituting a vacuum generating unit, and an atmospheric air introducing valve is disposed between the ejector and a vacuum port. The atmospheric air introducing valve is brought into a valve closed state at times when a negative pressure is generated by the ejector under a condition in which a workpiece is held by the negative pressure generated by the ejector, whereby communication between the vacuum port and the atmosphere is blocked. On the other hand, at times when the vacuum is broken, in which the negative pressure state of the vacuum port is released, the atmospheric air introducing valve is brought into a valve open state, whereby the vacuum port communicates with the atmosphere.

5 Claims, 4 Drawing Sheets

VACUUM GENERATING UNIT

BACKGROUND OF THE INVENTION

1. Field of the Invention

The present invention relates to a vacuum generating unit, which supplies a negative pressure to a working device such as a suction pad or the like, and more specifically, to a vacuum generating unit having a solenoid valve section therein capable of switching between supplying and cutting off supply of the negative pressure.

2. Description of the Related Art

Conventionally, a vacuum generating unit has been known, which is used, for example, as a workpiece transport mechanism or as a positioning mechanism. In such a vacuum generating unit, a suction mechanism such as a suction pad or the like is connected to the unit main body, whereby under the action of a negative pressure which is supplied from the unit main body, a workpiece can be attracted under suction by means of the suction mechanism. In addition, transportation of the workpiece is carried out, in which the workpiece is displaced while maintaining the suction state, and the workpiece is released at a predetermined location by canceling the suction state.

For example, in Japanese Laid-Open Patent Publication No. 2003-042134, a vacuum generating unit is disclosed in which a vacuum pump is utilized as a vacuum generating mechanism. In this vacuum generating unit, a vacuum generating valve is connected to the vacuum pump, and a vacuum-breaking valve is connected to a compressed air source, whereby airflows therefrom are controlled respectively. In addition, when the vacuum generating valve is switched from an OFF state to an ON state, a vacuum is generated in a vacuum port, while communication with atmosphere is cut off under a switching operation of an atmospheric pressure supply valve.

Further, the vacuum-generating device disclosed in Japanese Laid-Open Patent Publication No. 2002-224984 is equipped with a controller for ON/OFF control of the supply state of compressed air supplied from a supply port, and a vacuum generating section, which during an ON state, generates a vacuum by injecting, through a nozzle, the compressed air fed into a cylinder, passing the compressed air through a diffuser spool, and then discharging the compressed air from an exhaust port. Moreover, the diffuser spool is movably disposed in an axial direction inside the cylinder, such that, in the case that the supply of compressed air is turned OFF, the diffuser spool is moved, whereby the vacuum is capable of being broken via the exhaust port, an auxiliary pathway, and the diffuser spool.

However, in the conventional techniques according to Japanese Laid-Open Patent Publication No. 2003-042134 and Japanese Laid-Open Patent Publication No. 2002-224984, in order to quickly release the held state of the workpiece by the vacuum pressure, a vacuum breakage valve for breaking the vacuum and an atmospheric pressure supply valve are provided separately, and together therewith, a structure is provided in which the atmospheric pressure supply valve is normally in an open state, and compressed air, which is supplied to the diffuser for generating the vacuum pressure, is utilized for switching to a valve closed state. Owing thereto, for example, in the case that the vacuum generating unit is utilized in a pump system or the like, in which vacuum pressure is supplied from the exterior, because the diffuser is not provided, the atmospheric pressure supply valve cannot be switched to a valve closed state.

Further, in this type of vacuum generating unit, because attraction under suction of the workpiece is performed, whereupon the supplied amount of compressed air is reduced when the workpiece is in a held state, communication with the atmosphere results through the atmospheric pressure supply valve, which is in a valve open state, and thus holding of the workpiece cannot be performed.

SUMMARY OF THE INVENTION

A general object of the present invention is to provide a vacuum generating unit, which is capable of maintaining a negative pressure when the workpiece is being held, by allowing the vacuum port to communicate with atmosphere only at a positive pressure time when the negative pressure state is released or canceled.

The present invention includes a main body, in which a supply port through which a pressure fluid is supplied, a vacuum port connected to a suction mechanism, and an exhaust port for exhausting, to the exterior, the pressure fluid supplied from the supply port are disposed;

a vacuum generating mechanism for generating a negative pressure under an action of the pressure fluid supplied from the supply port;

a switching valve section having a supply valve and a vacuum breakage valve for switching the pressure of a pressure fluid supplied to the vacuum port between a negative pressure state and a positive pressure state;

an atmospheric air introducing valve disposed between the vacuum port and the vacuum generating mechanism, and which is capable of switching the communication state between the vacuum port and the atmosphere, wherein the atmospheric air introducing valve is placed in a valve closed state during a negative pressure state in which negative pressure is generated, and is placed in a valve open state during a positive pressure state in which the negative pressure state is released, whereby the vacuum port communicates with the atmosphere.

According to the present invention, an atmospheric air introducing valve is disposed between the vacuum port of the main body and the vacuum generating mechanism. The atmospheric air introducing valve is provided such that it is brought into a valve closed state during a negative pressure state in which negative pressure is generated by the vacuum generating mechanism, and is brought into a valve open state in a positive pressure state in which the negative pressure state is released. Owing thereto, at a negative pressure supply time when the negative pressure is generated, in a holding state where the workpiece is being held by the negative pressure, the atmospheric air introducing valve is brought into a valve closed state and the vacuum port is kept out of communication with the atmosphere, whereby the negative pressure state is appropriately maintained and the workpiece can be suitably and reliably held. In addition, in the case that the negative pressure state is switched to a positive pressure state, atmospheric air is supplied to the vacuum port through the atmospheric air introducing valve, which is placed in a valve open state, so that the held state of the workpiece is capable of being released in an appropriate manner.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
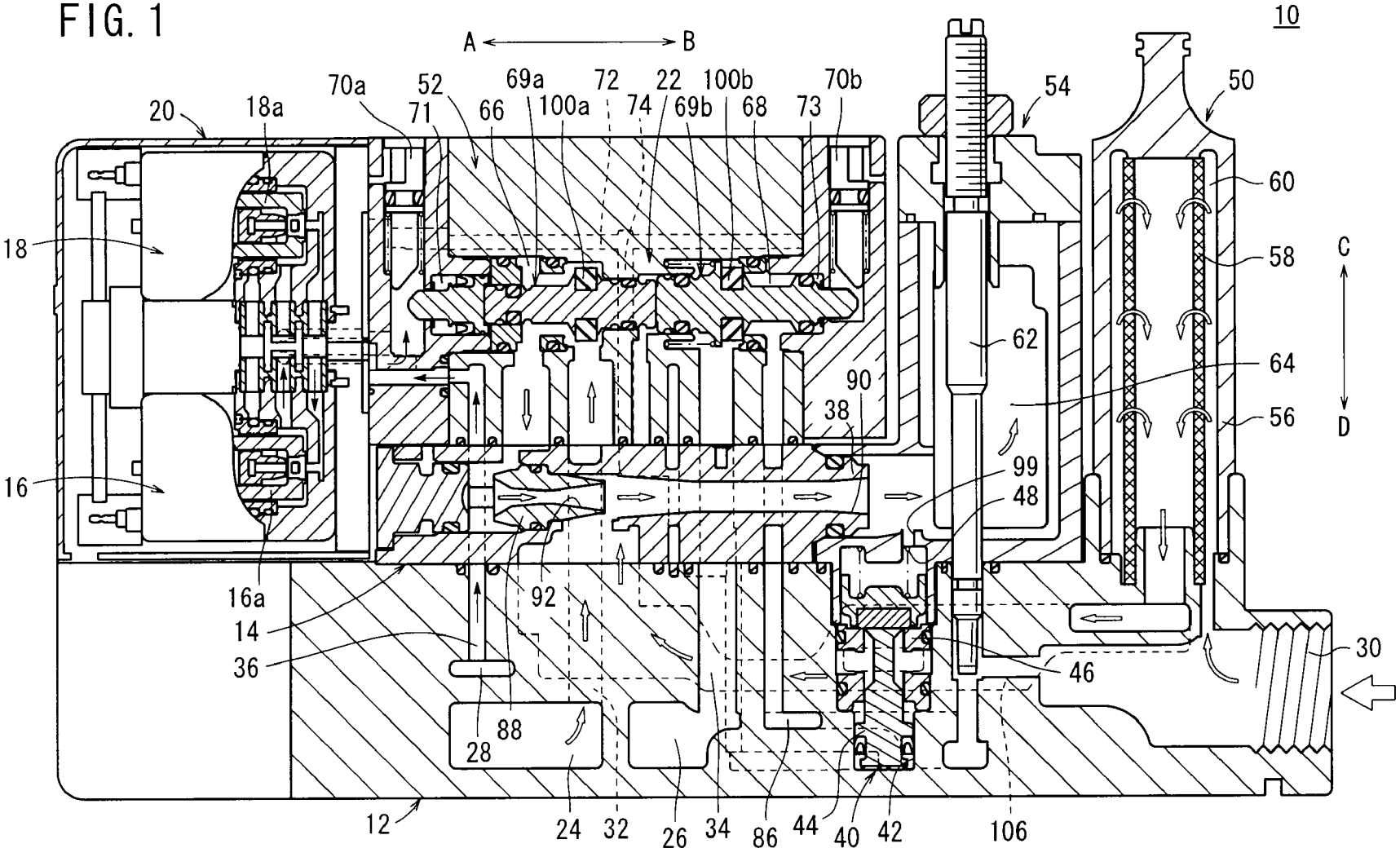
FIG. 1 is an overall cross sectional view of a vacuum generating unit according to an embodiment of the present invention.

In FIG. 1, reference numeral 10 indicates a vacuum generating unit according to an embodiment of the present invention.

The vacuum generating unit 10, as shown in FIGS. 1 through 4, includes a main body 12 formed with a predetermined length, an ejector 14 connected to a top portion of the main body 12 and functioning as a vacuum generating mechanism, a solenoid valve section 20 disposed at a side portion of the ejector 14 and having a pilot supply valve 16 and a pilot vacuum breakage valve 18, and a switching valve section 22 disposed on an upper portion of the ejector 14, which is displaced under the supply of pilot air thereto, for switching between a vacuum generating condition in which a negative pressure is generated and a vacuum breakage condition in which the negative pressure is released to atmospheric pressure.

The main body 12 has a predetermined length in the longitudinal direction (the direction of arrows A and B), wherein on a side surface of the main body 12, there are disposed a supply port 24 for supplying a pressure fluid (e.g., compressed air) to the ejector 14, a vacuum breakage port 26 separated a predetermined distance from the supply port 24 and through which a pressure fluid is supplied for breaking the vacuum state generated by the ejector 14, and a pilot port 28 that supplies pilot air with respect to the solenoid valve section 20 and the switching valve section 22. Further, a vacuum port 30, through which the negative pressure fluid generated by the ejector 14 is supplied, is formed on one end of the main body 12. A non-illustrated suction pad may be connected to the vacuum port 30 through a tube or the like.

Inside of the main body 12, there are provided a first supply passage 32 that extends from the supply port 24 to the ejector 14 (in the direction of the arrow C), a first vacuum breakage passage 34 that extends from the vacuum breakage port 26 to the ejector 14, and a first pilot passage 36 that extends from the pilot port 28 to the ejector 14. In addition, the first supply passage 32, the first vacuum breakage passage 34 and the first pilot passage 36 extend toward the switching valve section 22 (in the direction of the arrow C) while passing through the interior of a diffuser body 38 that constitutes the ejector 14.

Further, an atmospheric air introducing valve 40 is disposed in the main body 12 between the vacuum port 30 and the vacuum breakage port 26. The vacuum port 30 is opened to atmosphere under a switching operation of the atmospheric air introducing valve 40. The atmospheric air introducing valve 40 includes a valve body 44, which is displaceable along an axial direction (the direction of the arrow C) and is disposed in an installation hole 42 arranged substantially perpendicular to the longitudinal direction of the main body 12, a valve seat 46 disposed on an outer peripheral side of the valve body 44 and on which the valve body 44 is seated, and a spring 48, which urges the valve body 44 downwardly (in the direction of the arrow D). In addition, the atmospheric air introducing valve 40 is brought into a valve closed state, in which the valve body 44 is pressed downwardly by an elastic force of the spring 48 and is seated on the valve seat 46.

On the other hand, on an upper portion of the main body 12, a filter unit 50 is provided on one end portion thereof that includes the vacuum port 30, a sub-body (main body part) 52 with the switching valve section 22 incorporated therein is provided on a substantially central portion of the main body 12, and the solenoid valve section 20 having the pilot supply valve 16 and the pilot vacuum breakage valve 18 therein is disposed on the other end portion of the main body 12. Further, on the upper portion of the main body 12, an exhaust unit 54 is disposed between the sub-body 52 and the filter unit 50.

The filter unit 50 includes a bottomed cylindrical shaped casing 56 and a cylindrical shaped filter 58 disposed inside the casing 56. The filter unit 50 extends along a direction (the direction of the arrow C) substantially perpendicular to the longitudinal direction of the main body 12. A passage 60 through which a pressure fluid flows is disposed between an inner wall surface of the casing 56 and the filter 58. The pressure fluid that flows through the passage 60 flows toward the interior of the filter unit 50 through the filter 58. Owing thereto, for example, dust or the like contained within the fluid flowing in from the vacuum port 30 is suitably removed by passing through the filter 58, and the fluid flows to the interior of the main body 12 while passing through the inside of the filter 58.

The exhaust unit 54 is provided in parallel to and adjacent to the filter unit 50. The exhaust unit 54 is equipped with an adjustment needle 62 which is capable of adjusting the flow rate of the fluid that flows at a time when the vacuum is broken, and an exhaust port 64 communicating with the ejector 14, which discharges the pressure fluid that has flowed through the ejector 14 to the outside.

The adjustment needle 62 is disposed so as to be displaceable along the axial direction (the direction of the arrow C) of the exhaust unit 54. During times when the vacuum is broken, the flow passage through which the fluid flows is regulated by the adjustment needle 62, whereby the flow rate of the fluid is adjusted.

The solenoid valve section 20 is formed from the paired pilot supply valve 16 and pilot vacuum breakage valve 18, which are arranged in parallel. The pilot supply valve 16 and the pilot vacuum breakage valve 18 are each connected electrically with respect to a controller (not shown). In addition, based on control signals from the unillustrated controller, solenoids of the pilot supply valve 16 and the pilot vacuum breakage valve 18 are excited, whereby opening and closing operations of the valve bodies 16*a*, 18*a* therein are carried out.

Further, the pilot supply valve 16 and the pilot vacuum breakage valve 18 are arranged in parallel along the longitudinal direction (the direction of the arrows A and B) of the main body 12, and on one end side thereof facing the sub-body 52, valve bodies 16*a*, 18*a* are disposed displaceably, so as to be capable of switching the communication state of pilot air supplied from the pilot port 28.

The sub-body 52 is disposed on the upper portion of the main body 12 while the ejector 14 is sandwiched between the sub-body 52 and the main body 12, and first and second cylinder chambers 66, 68 that penetrate along the longitudinal direction thereof are formed in a central portion of the sub-body 52. Inside the first and second cylinder chambers 66, 68, a vacuum supply valve 69*a* and a vacuum breakage valve 69*b*, which make up the switching valve section 22, are displaceably disposed. The vacuum supply valve 69*a* is arranged in the first cylinder chamber 66 on the side of the solenoid valve section 20 (in the direction of the arrow A), whereas the vacuum breakage valve 69*b* is arranged in the second cylinder chamber 68 on the side of the exhaust unit 54 (in the direction of the arrow B). A vacuum supply valve switching piston chamber 71, to which pilot air is supplied, is disposed on the solenoid valve section 20 side of the vacuum supply valve 69*a*.

Further, manual switching valves 70*a*, 70*b* are provided respectively on both ends of the sub-body 52. The manual switching valves 70*a*, 70*b* are capable of manually switching the vacuum supply state and the vacuum breakage state, in place of the vacuum supply valve 69*a* and the vacuum breakage valve 69*b* being displaced under the supply of pilot air.

Furthermore, a bypass passage 72 penetrates through the sub-body 52 interconnecting the manual switching valves 70*a*, 70*b*. The bypass passage 72 communicates through the manual switching valve 70*b* with a vacuum breakage valve switching piston chamber 73 in which the vacuum breakage valve 69*b* is disposed, and also is connected to a branch passage 74, which branches off at a substantially central region toward the side of the ejector 14 (in the direction of the arrow D). Additionally, pilot air, the communication state of which has been switched by the pilot vacuum breakage valve 18 of the solenoid valve section 20, flows to the vacuum breakage valve switching piston chamber 73 from the pilot port 28 through the bypass passage 72.

The branch passage 74 extends to the main body 12 passing through the diffuser body 38 of the ejector 14, and further extends to and communicates with the installation hole 42 of the atmospheric air introducing valve 40. In addition, pilot air that flows through the branch passage 74 is supplied to the installation hole 42, whereby the valve body 44 constituting the atmospheric air introducing valve 40 is displaced upwardly (in the direction of the arrow C) in opposition to the elastic force of the spring 48. That is, the valve body 44 is placed in a valve open state in which the valve body 44 is separated from the valve seat 46 (refer to FIGS. 3 and 4).

On the other hand, a second supply passage 76, a second vacuum breakage passage 78, and a second pilot passage 80 are formed in a lower portion of the sub-body 52 so as to face toward the ejector 14. The second supply passage 76, the second vacuum breakage passage 78, and the second pilot passage 80 are arranged on a straight line with the first supply passage 32, the first vacuum breakage passage 34, and the first pilot passage 36 of the main body 12, respectively. More specifically, the second supply passage 76 communicates with the supply port 24 through the first supply passage 32, the second vacuum breakage passage 78 communicates with the vacuum breakage port 26 through the first vacuum breakage passage 34, and the second pilot passage 80 communicates with the pilot port 28 through the first pilot passage 36.

Furthermore, a first communication passage 82, which is separated a predetermined distance from the second supply passage 76 and is disposed on the side of the solenoid valve section 20 (in the direction of the arrow A), and a second communication passage 84, which is separated a predetermined distance from the second vacuum breakage passage 78 and is disposed on the side of the exhaust unit 54 (in the direction of the arrow B), are provided on the lower portion of the sub-body 52. In addition, a lower part of the first communication passage 82 communicates with the diffuser body 38 of the ejector 14, whereas a lower part of the second communication passage 84 is connected to and communicates with a third communication passage 86 formed in the main body 12.

The ejector 14 is disposed between the main body 12 and the sub-body 52, and includes the cylindrical shaped diffuser body 38 and a nozzle 88, which is disposed coaxially on an upstream side of the diffuser body 38.

The diffuser body 38 is fitted between the main body 12 and the sub-body 52, and a first passage 90, which penetrates along the axial direction, is formed in the interior of the diffuser body 38 on the exhaust unit 54 side (in the direction of the arrow B) thereof.

Further, a plurality of annular grooves, which are separated by predetermined distances along the axial direction, are formed on the outer peripheral surface of the diffuser body 38. The first supply passage 32, the first vacuum breakage passage 34, and the third communication passage 86 of the main body 12 communicate mutually through the annular grooves with the second supply passage 76, the second vacuum breakage passage 78, and the second communication passage 84 of the sub-body 52. The annular grooves and the first passage 90 are in a non-communicative state.

The nozzle 88 is fitted into the other end side of the diffuser body 38 on the side of the solenoid valve section 20 (in the direction of the arrow A), and the nozzle 88 is formed with a second passage 92 therein, which penetrates along the axial direction. The second passage 92 communicates with the first passage 90 through a diffuser chamber 94, which is formed inside the diffuser body 38. The first and second passages 90, 92 are formed with tapered shapes that gradually expand in diameter in the direction of the exhaust chamber 96, which is formed at the exhaust unit 54 side (in the direction of the arrow B) of the diffuser body 38.

More specifically, in the ejector 14, the supply chamber 98 to which the fluid is supplied, the second passage 92, the diffuser chamber 94, the first passage 90 and the exhaust chamber 96 are disposed coaxially from the upstream side (the direction of the arrow A) toward the downstream side (the direction of the arrow B) thereof. The fluid supplied to the supply chamber 98, after having passed through the second passage 92, the diffuser chamber 94, the first passage 90, and the exhaust chamber 96, flows through and is discharged by the exhaust port 64.

Further, the exhaust chamber 96 is disposed upwardly of the atmospheric air introducing valve 40. Moreover, a check valve can be arranged in the diffuser chamber 94, whereby a suction passage 106 is made to communicate with the diffuser chamber 94 when a vacuum is generated, whereas when the vacuum is stopped, communication between the diffuser chamber 94 and the suction passage 106 is blocked.

The switching valve section 22 is disposed in the first and second cylinder chambers 66, 68 formed in the sub-body 52. The vacuum supply valve 69*a* and the vacuum breakage valve 69*b* are each formed respectively with shaft-like shapes. More specifically, the vacuum supply valve 69*a* and the vacuum breakage valve 69*b* making up the switching valve section 22 are disposed on the same axis, and are displaced integrally when the vacuum breakage valve 69*b* is displaced in the direction of the arrow A inside the first and second cylinder chambers 66, 68.

Further, at the connecting portion of the vacuum supply valve 69*a* and the vacuum breakage valve 69*b*, a restoring spring (not shown) may be arranged, which causes the vacuum supply valve 69*a* to be returned on its own.

The vacuum supply valve 69*a* is arranged so as to face the first communication passage 82 and the second supply passage 76, and a ring body 100*a* formed from an elastic material is installed on an outer peripheral surface thereof.

Figure 4:
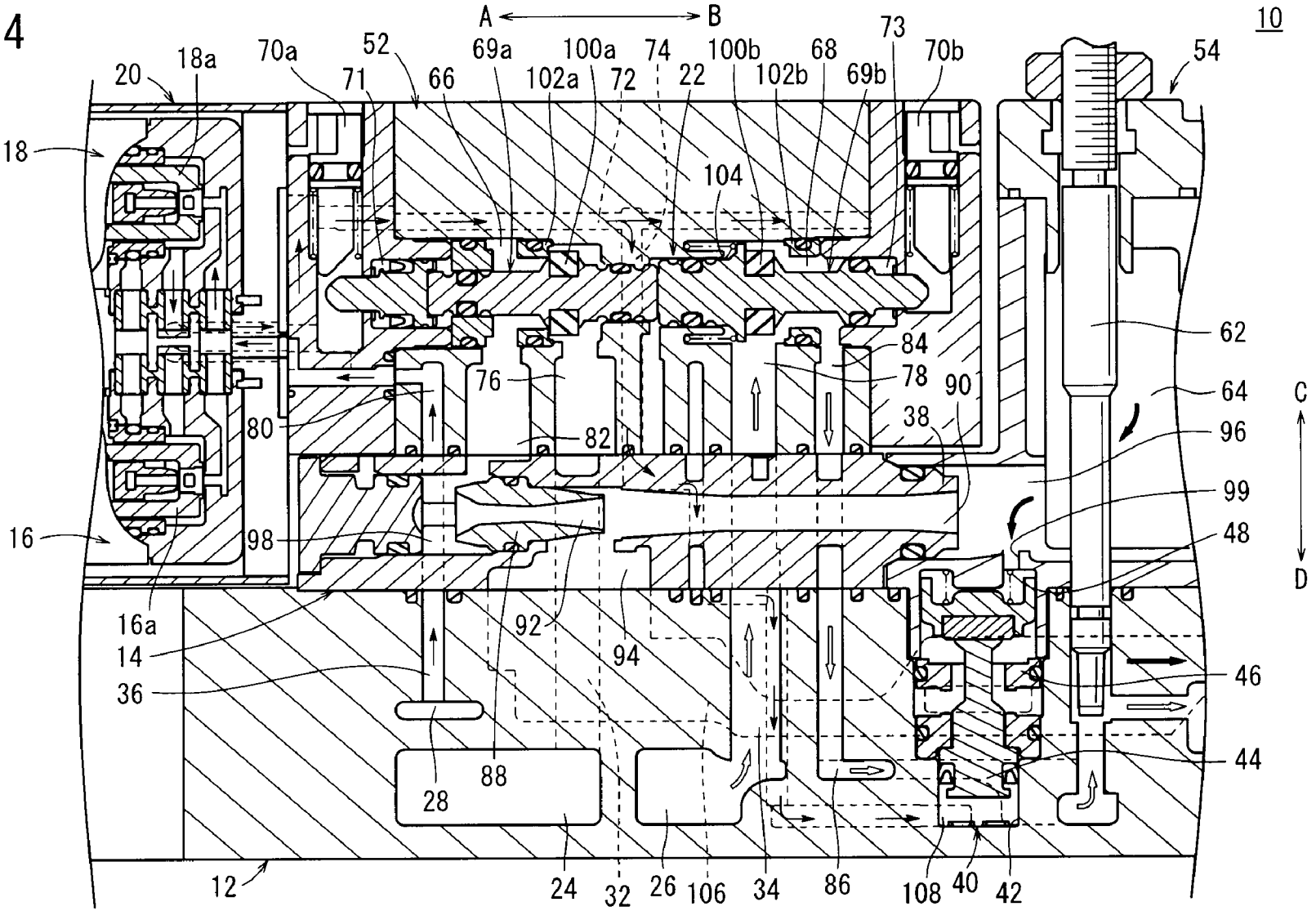
FIG. 4 is an enlarged cross sectional view showing a vicinity of the ejector and the switching valve section in the vacuum generating unit of FIG. 3.

Additionally, upon displacement of the vacuum supply valve 69*a*, by seating of the ring body 100*a* on the valve seat 102*a*, the state of communication between the first communication passage 82 and the second supply passage 76 through the first cylinder chamber 66 is blocked (see FIG. 4). Stated otherwise, the vacuum supply valve 69*a* functions as a switching valve for switching the flow state of the fluid from the second supply passage 76 to the first communication passage 82.

Figure 2:
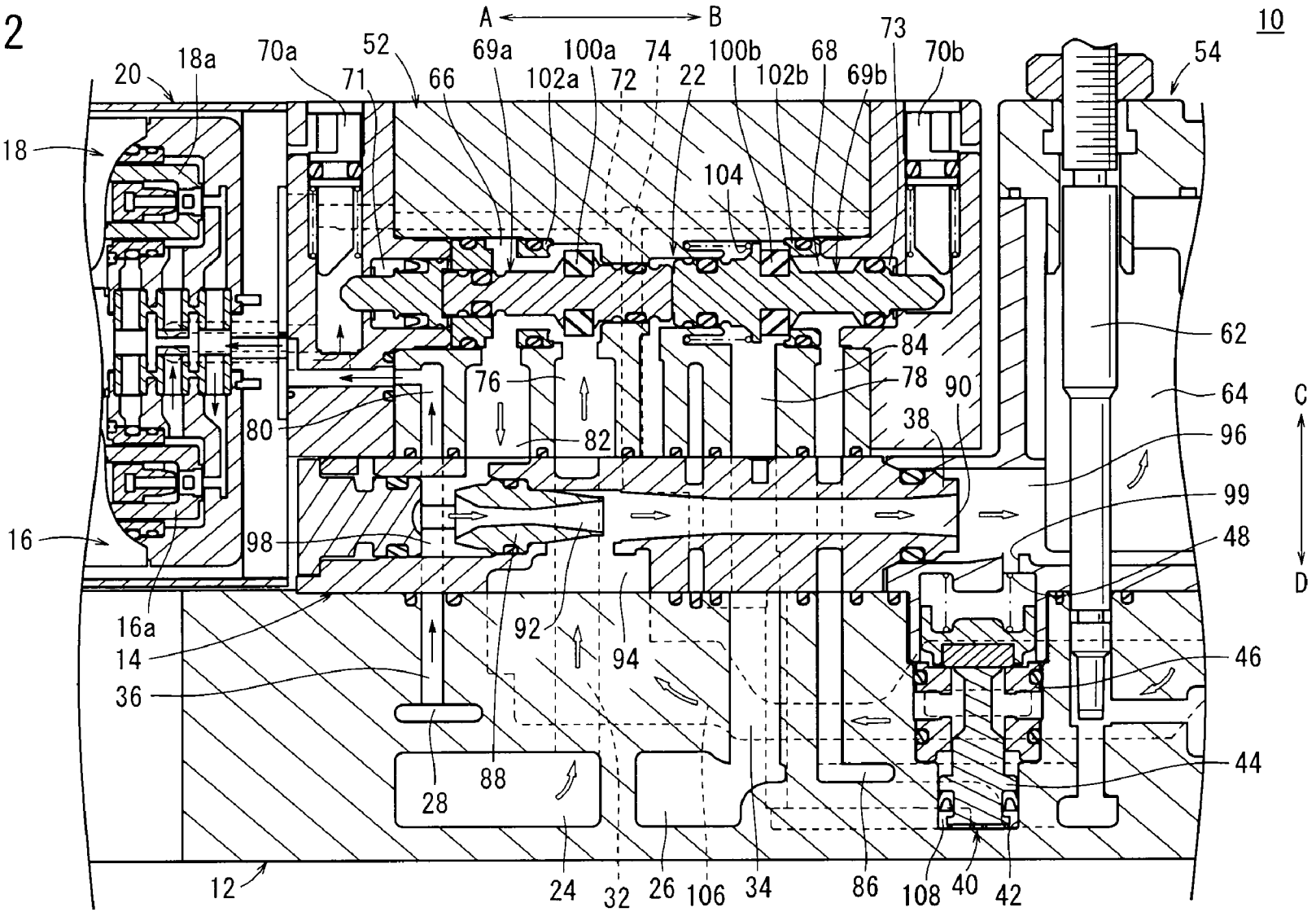
FIG. 2 is an enlarged cross sectional view showing the vicinity of an ejector and a switching valve section in the vacuum generating unit of FIG. 1.
Figure 3:
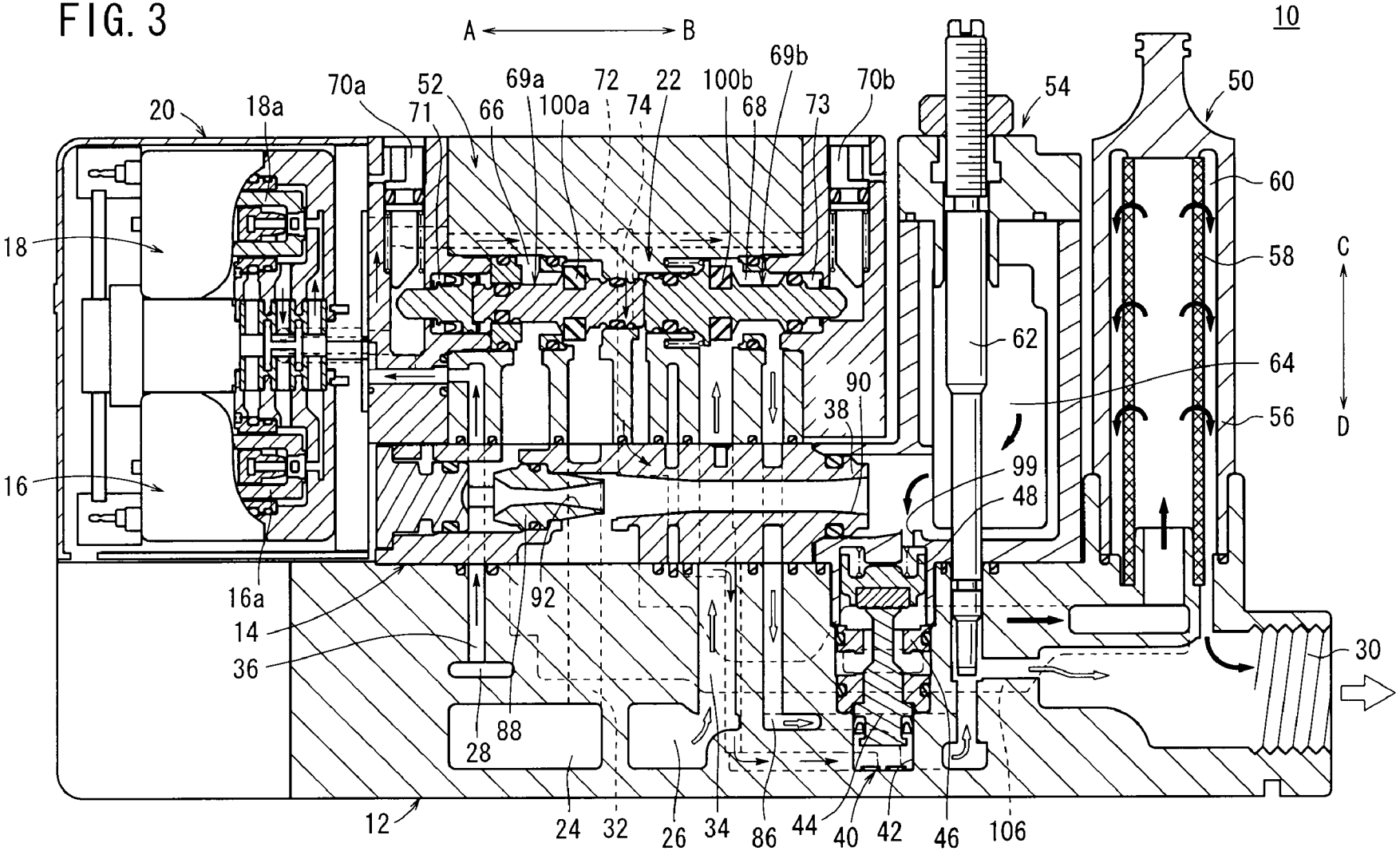
FIG. 3 is an overall cross sectional view showing a condition in which a vacuum state is released under a switching operation of a vacuum breakage valve in the vacuum generating unit of FIG. 1.

Further, the vacuum supply valve 69*a* is pressed toward the side of the vacuum breakage valve 69*b* (in the direction of the arrow B) by the pilot air which is supplied by operating the pilot supply valve 16, thereby resulting in a valve open state, in which the ring body 100*a* is separated away from the valve seat 102*a* (see FIG. 2).

The vacuum breakage valve 69*b* is arranged so as to face the second communication passage 84 and the second vacuum breakage passage 78, and a ring body 100*b* formed from an elastic material is installed on an outer peripheral surface thereof. Additionally, upon displacement of the vacuum breakage valve 69*b*, by seating of the ring body 100*b* on the valve seat 102*b*, the state of communication between the second communication passage 84 and the second vacuum breakage passage 78 through the second cylinder chamber 68 is blocked (see FIG. 2). Stated otherwise, the vacuum breakage valve 69*b* functions as a switching valve for switching the flow state of the fluid from the second vacuum breakage passage 78 to the second communication passage 84.

Further, a spring 104 is installed between the sub-body 52 and the vacuum breakage valve 69*b*, whereby under the elastic restorative force of the spring 104, the vacuum breakage valve 69*b* is displaced in a direction (the direction of the arrow B) to separate away from the vacuum supply valve 69*a*, thus resulting in a valve closed state in which the ring body 100*b* is displaced toward and seated on the valve seat 102*b* (see FIG. 2).

Furthermore, by means of the pilot air supplied to the vacuum breakage valve switching piston chamber 73 through the bypass passage 72 of the sub-body 52, the vacuum breakage valve 69*b* is pressed toward the side of the vacuum supply valve 69*a* (in the direction of the arrow A), resulting in a valve open state in which the ring body 100*b* separates from the valve seat 102*b* by being displaced in opposition to the elastic force of the spring 104 (see FIG. 4). Accordingly, the fluid supplied to the second vacuum breakage passage 78 from the vacuum breakage port 26 flows toward the second communication passage 84 through the second cylinder chamber 68. At the same time, the ring body 10*a* is seated on the valve seat 102*a*.

The vacuum generating unit 10 according to the embodiment of the present invention is basically constructed as described above. Next, operations and effects of the vacuum generating unit 10 shall be explained.

In the case of transporting an unillustrated workpiece, a control signal is output to the pilot supply valve 16 through a controller (not shown), whereupon the valve body 16*a* of the pilot supply valve 16 is moved to result in a valve open state. Owing thereto, as shown in FIGS. 1 and 2, pilot air, which is supplied to the pilot supply valve 16 from the pilot port 28 through the first and second pilot passages 36, 80, is supplied by the pilot supply valve 16 to the vacuum supply valve switching piston chamber 71 in which the vacuum supply valve 69*a* is disposed. Together therewith, the vacuum supply valve 69*a* is pressed by the pilot air toward the side of the vacuum breakage valve 69*b* (in the direction of the arrow B), and the ring body 100*a* separates from the valve seat 102*a*, whereby the second supply passage 76 and the first communication passage 82 are brought into a state of communication. As a result, after the pressure fluid, which is introduced from the supply port 24, has flowed through the first and second supply passages 32, 76 and to the first communication passage 82, the pressure fluid is introduced to the interior of the diffuser body 38 constituting the ejector 14.

In addition, the pressure fluid flows in succession from the supply chamber 98 of the ejector 14, the second passage 92 of the nozzle 88, and to the first passage 90 of the diffuser body 38, thereby generating a negative pressure. At this time, because the ejector 14 communicates with the vacuum port 30 through the suction passage 106 formed inside the main body 12, under action of the negative pressure generated inside the ejector 14, the outside air is sucked inwardly through the vacuum port 30. The outside air, after having passed through the filter 58 from inside the casing 56 of the filter unit 50, flows toward the ejector 14. As a result, a negative pressure fluid is supplied to a suction pad (not shown), which is connected to the vacuum port 30, and a workpiece can be attracted under suction to the suction pad. The pressure fluid that has passed through the first passage 90 in the ejector 14 passes through the exhaust chamber 96 and is discharged to the outside from the exhaust port 64.

An explanation shall now be made, for example, of a case in which, after the workpiece has been transported to a predetermined location through an unillustrated robot or the like while the attracted state of the workpiece by the suction pad is maintained, supply of the negative pressure fluid to the suction pad is released, whereupon the workpiece is made to separate away (i.e., become detached) from the suction pad at the predetermined location.

A stop signal is output with respect to the pilot supply valve 16 from the unillustrated controller, whereupon operation of the pilot supply valve 16 is halted and supply of pilot air to the vacuum supply valve switching piston chamber 71 is terminated. On the other hand, a control signal is output with respect to the pilot vacuum breakage valve 18 and the valve body 18*a* is operated on, resulting in a valve open state, whereupon the flow state of the pilot air supplied from the pilot port 28 is switched, and the pilot air flows to the bypass passage 72.

The pilot air passes through the bypass passage 72 and is supplied to the vacuum breakage valve switching piston chamber 73, whereupon the vacuum breakage valve 69*b* is displaced toward the side of the vacuum supply valve 69*a* (in the direction of the arrow A) in opposition to the elastic force of the spring 104. Owing thereto, the ring body 100*b* making up the vacuum breakage valve 69*b* separates from the valve seat 102*b* and the second vacuum breakage passage 78 and the second communication passage 84 are placed in a state of communication (see FIGS. 3 and 4). Consequently, after the pressure fluid introduced from the vacuum breakage port 26 passes through the first and second vacuum breakage passages 34, 78 and has flowed into the second communication passage 84, the pressure fluid is supplied to the vacuum port 30.

On the other hand, a portion of the pilot air that was supplied to the bypass passage 72 branches into the branch passage 74 and flows to the side of the ejector 14, whereupon the pilot air is introduced to the cylinder chamber 108 disposed on the lower side of the atmospheric air introducing valve 40. Owing thereto, the valve body 44 constituting the atmospheric air introducing valve 40 is displaced upwardly (in the direction of the arrow C) in opposition to the elastic force of the spring 48, resulting in a valve open state in which the valve body 44 is separated from the valve seat 46 (see FIG. 4). Consequently, the exhaust chamber 96 of the ejector 14 that communicates with the exhaust port 64 is placed in communication through the communication port 99 with the interior of the atmospheric air introducing valve 40, and together therewith, the filter unit 50 and the vacuum port 30 communicate mutually with one another. As a result, outside air introduced from the exhaust port 64 is discharged to the outside through the filter unit 50 and through the vacuum port 30.

More specifically, supply of the negative pressure fluid to the vacuum port 30 is halted, and at a time of vacuum breakage, which enables the attracted state of the workpiece to be released, the fluid supplied from the vacuum breakage port 26 is supplied to the vacuum port 30, and the outside air introduced from the exhaust port 64 is supplied to the vacuum port 30 under a switching action of the atmospheric air introducing valve 40.

Additionally, the fluid and the outside air are supplied to the unillustrated suction pad (not shown) through the vacuum port 30, whereby the attracted state of the workpiece by the suction pad is released.

In the foregoing manner, with the present embodiment, the atmospheric air introducing valve 40 disposed in the main body 12 is normally kept in a valve closed state under the elastic force of the spring 48, and a valve open state, in which the valve body 44 is displaced by supplying pilot air thereto, can be provided only when the vacuum is broken. That is, because the pilot pressure can be utilized when the vacuum breakage valve 69*b* is driven and breakage of the vacuum is carried out, the vacuum breakage valve 69*b* is not coupled to or interlocked with operation of the ejector 14. As a result, the invention can be applied to a vacuum pump system in which vacuum pressure is supplied externally and which is not equipped with the ejector 14. Compared to a case in which a vacuum generating unit 10 equipped with the ejector 14 and a vacuum generating unit that is not equipped with an ejector are set up separately and used respectively for different situations, equipment costs can be suppressed.

Further, because the atmospheric air introducing valve 40 is brought into a valve closed state under a condition in which vacuum generation is halted, by arranging a restoring spring that restores the vacuum supply valve 69*a* and providing a check valve in the diffuser chamber 94, even in the case of a non-excited state, maintenance of the vacuum can reliably be carried out, and because the exhaust air is not consumed, energy savings can be realized. That is, the atmospheric air introducing valve 40 is brought into a valve open state and an atmospherically opened state only at a time when the vacuum is broken. As a result, a held state of a workpiece by the suction pad (not shown) connected to the vacuum port 30 is suitably maintained by arranging the check valve.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. A vacuum generating unit comprising:

a main body, in which a supply port through which a pressure fluid is supplied, a vacuum port connected to a suction mechanism, and an exhaust port for exhausting, to the exterior, the pressure fluid supplied from said supply port are disposed;

a vacuum generating mechanism for generating a negative pressure under an action of the pressure fluid supplied from said supply port;

a switching valve section having a supply valve and a vacuum breakage valve for switching a pressure of a pressure fluid supplied to said vacuum port between a negative pressure state and a positive pressure state;

an atmospheric air introducing valve disposed between said vacuum port and said vacuum generating mechanism, and which is capable of switching the communication state between said vacuum port and the atmosphere, wherein said atmospheric air introducing valve is placed in a valve closed state during a negative pressure state in which negative pressure is generated, and is placed in a valve open state during a positive pressure state in which the negative pressure state is released, thereby causing said vacuum port to communicate with the atmosphere.

2. The vacuum generating unit according to claim 1, wherein a vacuum breakage port, which supplies a pressure fluid to said vacuum port upon switching from the negative pressure state to the positive pressure state, is disposed in said main body, wherein the pressure fluid supplied to said vacuum breakage port is introduced to said atmospheric air introducing valve under a switching action of said switching valve section.

3. The vacuum generating unit according to claim 2, wherein said supply valve and said vacuum breakage valve are formed on the same axis, said supply valve being disposed so as to be capable of switching a flow state of the pressure fluid supplied to said supply port, and said vacuum breakage valve being disposed so as to be capable of switching a flow state of the pressure fluid supplied to said vacuum breakage port.

4. The vacuum generating unit according to claim 3, wherein a filter unit is disposed in said main body, said filter unit having a filter capable of removing dust contained in the fluid that flows in from said vacuum port.

5. The vacuum generating unit according to claim 4, further comprising an exhaust unit having an adjustment needle capable of adjusting a flow amount of fluid flowing at a time of vacuum breakage, and said exhaust port communicating with said vacuum generating mechanism, and which exhausts, to the exterior, the pressure fluid that has flowed through said vacuum generating mechanism.

* * * * *